US006351064B1

(12) United States Patent
Frayssinet

(10) Patent No.: US 6,351,064 B1
(45) Date of Patent: Feb. 26, 2002

(54) CONDUCTIVE PATH UNDER A FLAT DISPLAY SCREEN SEALING WALL

(75) Inventor: Thierry Frayssinet, Jacou (FR)

(73) Assignee: Pixtech S.A. (FR)

( * ) Notice: Subject to any disclaimer, the term of this patent is extended or adjusted under 35 U.S.C. 154(b) by 0 days.

(21) Appl. No.: 09/282,899

(22) Filed: Mar. 31, 1999

(30) Foreign Application Priority Data

Mar. 31, 1998 (FR) ..... 98 04204

(51) Int. Cl.[7] ..... H01J 1/62; H01R 3/00; H01R 12/24

(52) U.S. Cl. ..... 313/495; 313/491; 439/492; 439/493; 439/496

(58) Field of Search ..... 313/309, 336, 313/351, 495, 491, 496, 497; 439/492, 493, 496; 174/262, 255, 263

(56) References Cited

U.S. PATENT DOCUMENTS 3,842,308 A * 10/1974 Van Esdonk et al. ..... 313/584

FOREIGN PATENT DOCUMENTS

| | | |
|---|---|---|
| DE | 671327 | 1/1939 |
| FR | 2707787 | 1/1995 |
| GB | 496679 | 5/1938 |

OTHER PUBLICATIONS

Copy of Franch Search Report for 98 04204, dated Dec. 3, 1998.

* cited by examiner

*Primary Examiner*—Michael H. Day
*Assistant Examiner*—Joseph Williams
(74) *Attorney, Agent, or Firm*—Duane Morris; Arthur L. Plevy

(57) ABSTRACT

The present invention relates to an electric connection between the internal space of a flat screen and the outside by means of a conductive line of small thickness underlying a substantially thicker peripheral seal, and including an open-worked structure making its expansion easier, said open-worked structure being such that the electric connection has no rectilinear conductive section.

5 Claims, 3 Drawing Sheets

CONDUCTIVE PATH UNDER A FLAT DISPLAY SCREEN SEALING WALL

BACKGROUND OF THE INVENTION

1. Field of the Invention

The present invention relates to flat display screens. It more specifically relates to the transfer of electric connections between the inside and the outside of a tight chamber defined by two plates respectively forming the bottom and the surface of the screen.

2. Discussion of the Related Art

Conventionally, a flat screen is formed of two generally rectangular external plates, for example made of glass. One plate forms the screen surface, while the other forms the screen bottom, for example, provided with the emission means. The two plates are assembled by means of a seal, to be spaced apart from each other. For a field effect display (FED) or microtip screen, or for a vacuum fluorescent display (VFD), vacuum is made in the space separating the two glass plates, while, for a plasma screen, this space is filled with low pressure gas.

To simplify the present description, only microtip screens will be considered hereafter, but it should be noted that the present invention generally relates to the various above-mentioned display types and the like.

FIGS. 1A and 1B partially and schematically show the conventional structure of a microtip screen. FIG. 1A is a cross-sectional view. FIG. 1B is a plane view along line B–B' of FIG. 1A.

Such a microtip screen is essentially formed, on a first substrate 1 (FIG. 1A), for example made of glass, of a cathode 2 with microtips 3 and of a grid 4. The cathode-grid is placed opposite a cathodoluminescent anode 5 made on a second substrate 6, for example, in glass, which generally forms the transparent screen surface.

The operating principle and the detail of the structure of such a screen are described, for example, in U.S. Pat. No. 4,940,917 assigned to the Commissariat à l' Energie Atomique.

Cathode-grid 2-4 and anode 5 are made separately on the two substrates 1 and 6 and are subsequently assembled by means of a peripheral seal or sealing wall 7. Substrates 1 and 6 define an empty space 8 for the circulation of the electrons from cathode 2 to anode 5.

Cathode 2 is organized in columns 9 and comprises, on substrate 1, cathode conductors arranged in meshes from a conductive layer. Microtips 3 are generally made on a resistive layer deposited on the cathode conductors and are arranged inside the meshes defined by the cathode conductors. In FIG. 1A, the cathode conductors and the resistive layer have been designated by common reference 9 identifying different columns. Grid 4 is organized in conductive lines 10 (FIG. 1B) deposited on an insulating layer 11 (for example, made of silicon oxide ($SiO_2$)). Holes 12 are formed in lines 10 of grid 4 and in insulating layer 11 to receive each microtip 3. The intersection of a line of grid 4 and of a column of cathode 2 generally defines a screen pixel.

On the anode side, phosphor elements (not shown) are deposited on electrodes formed in a generally transparent conductive layer and are excited by electrons emitted by the cathode. For clarity, the anode and all its components have been designated by general reference 5 in FIG. 1A.

To properly bias (address) the different conductors of cathode 2, of grid 4, and of anode 5, these conductors have to be accessible from the outside of the chamber closed by a sealing wall 7, generally a fusible glass cord.

A problem which is raised at the passing of the sealing wall is due to the very different characteristics of the materials above and under the wall. This problem is essentially raised for lines 10 of grid 4 which are above the stack on the cathode-grid side.

There is the silicon oxide constitutive of layer 11 with a thickness of about one micrometer, the metal, generally niobium, constitutive of grid layer 4 with a thickness under one micrometer, and the material (generally, fusible glass) constitutive of sealing wall 7 with a thickness of several hundred micrometers. The differences between the intrinsic characteristics of the materials, associated with the high thickness differences between these layers of materials, result in stress which causes cracks in the silicon oxide constitutive of layer 11 of insulation between the grid lines and the cathode columns. Such cracks can extend on either side of the sealing wall and create leaks between the inside under vacuum and the outside of the screen.

The stress essentially results from the different thermal expansion coefficients between the materials forming the stack under the sealing wall. Accordingly, upon addition of the high temperature fusible glass cord, the above-mentioned defects appear.

Another problem arises for lines 10 of grid 4. Indeed, in a conventional screen, the conductive layer constitutive of lines 10 of grid 4 is the last layer deposited on cathode-grid plate 1. Accordingly, the fusible glass constitutive of wall 7 is directly deposited on end sections or extensions 10' of connection of lines 10 to the outside. Generally, the grid lines are formed of niobium and an etching of the niobium by the glass constitutive of seal 7 is observed. This results in risks of screen malfunction due to the interruption of some lines 10 between the inside and the outside of the screen.

SUMMARY OF THE INVENTION

The present invention aims at overcoming the disadvantages of conventional screens in relation with the passing of a conductive path between the inside and the outside of the screen.

The present invention aims, in particular, at providing a novel microtip screen in which any risk of a leak between the inside and the outside of the screen, linked to the passing of the grid conductors under the sealing wall, is suppressed.

The present invention further aims at providing a solution which minimizes the modifications to be brought to conventional methods of microtip screen manufacturing and sealing.

To achieve these objects, the present invention provides an electric connection between the internal space of a flat screen and the outside by means of a conductive line of small thickness underlying a substantially thicker peripheral seal, and including an open-worked structure making its expansion easier, the open-worked structure being such that the electric connection has no rectilinear conductive section.

The present invention further provides a flat microtip screen grid formed of lines deposited on an insulating layer coating cathode conductors, each grid line being provided with at least one electric connection.

According to an embodiment of the present invention, the grid is made of chromium.

According to an embodiment of the present invention, each line is made of niobium in the active screen area, each electric connection being made of chromium.

The present invention further provides a flat display screen of the type including a cathode with microtips; for bombarding a cathodoluminescent anode, and including a grid.

The foregoing objects, features and advantages of the present invention will be discussed in detail in the following non-limiting description of specific embodiments, in conjunction with the accompanying drawings.

DETAILED DESCRIPTION

Figure 1A:
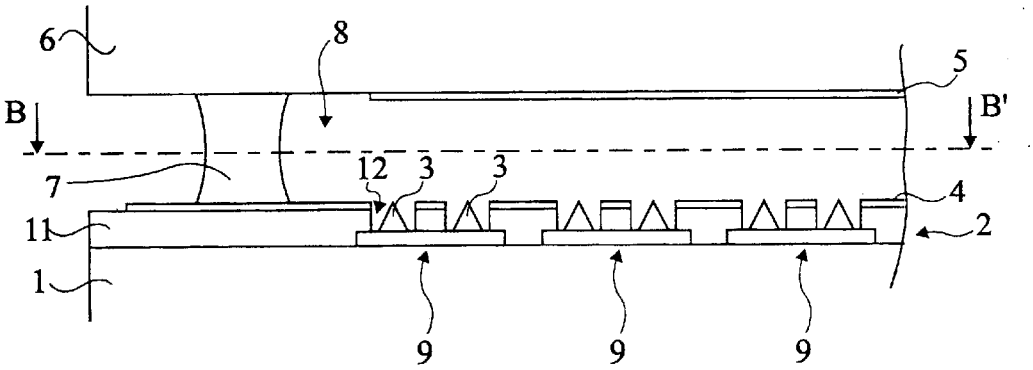
Fig 1A ( prior art )
FIGS. 1A and 1B, previously described, illustrate the state of the art and the problem to solve.
Figure 1B:
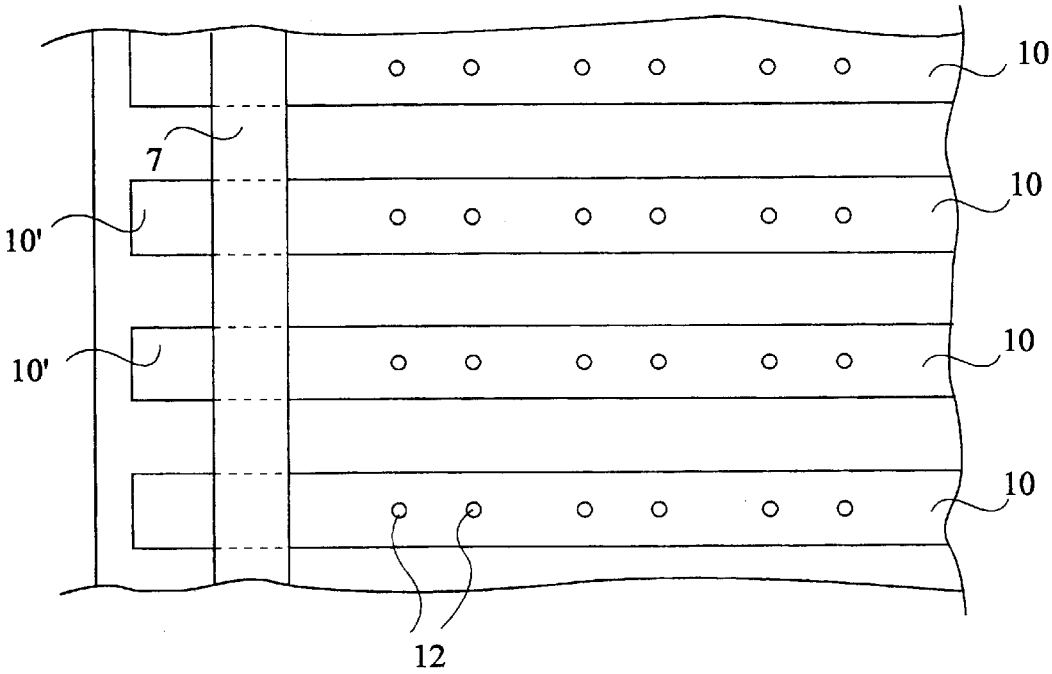
Fig 1B ( prior art )

The same elements have been referred to with the same references in the different drawings. For clarity, the representations of the drawings are not to scale and only those elements necessary to the understanding of the present invention have been shown in the drawings and will be described hereafter.

A characteristic of the present invention is to help the expansion of conductive lines, here, grid lines, under the sealing wall separating the internal screen space from the outside. For this purpose, the present invention provides to make openings in the conductive layer constitutive of the grid lines in a portion of these lines meant to be under the sealing wall.

Figure 2:
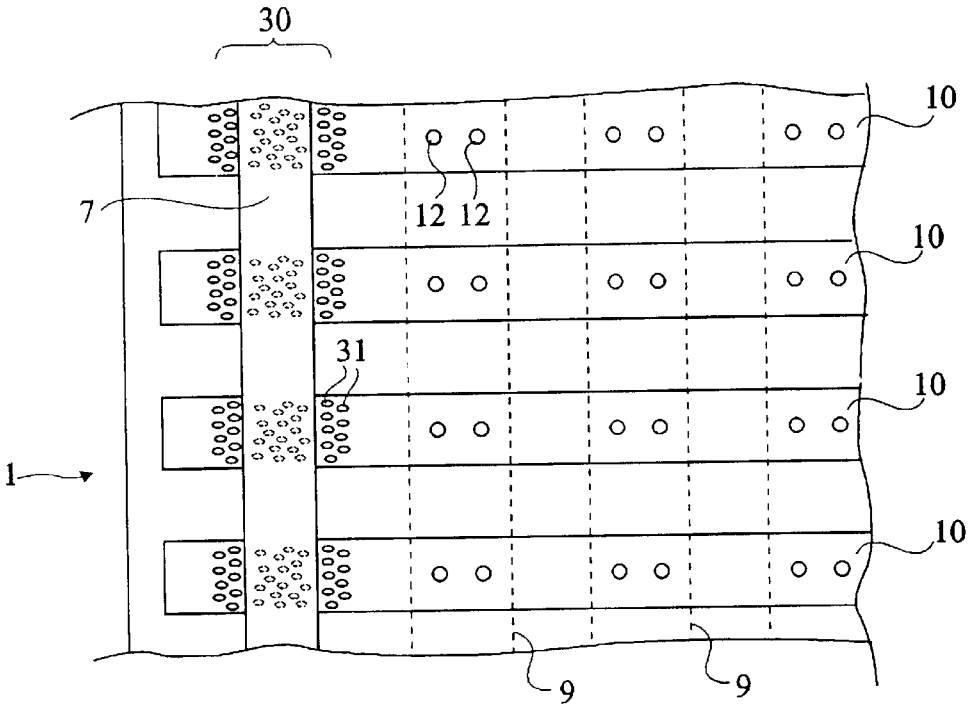
FIG. 2 partially shows, in top view, a cathode-grid of a flat microtip screen illustrating a first embodiment of a grid connection according to the present invention.

FIG. 2 illustrates a first embodiment of the present invention. This drawing very schematically shows a plate 1 supporting the cathode-grid of a flat microtip screen. The screen cathode is identical to that of a conventional screen. In FIG. 2, cathode columns 9 have been illustrated by dotted lines.

In the active screen area, that is, in the area including microtips, grid lines 10 are similar to those of a conventional screen, that is, they include holes 12 above the microtips. Although, for clarity, only two microtips per pixel have been shown in the drawings, it should be noted that these microtips and the corresponding holes 12 of the grid are several thousands per screen pixel.

According to the present invention, lines 10, instead of being solid at the passing under screen sealing wall 7, are open-worked to allow their expansion and thus minimize the stress applied thereto. In a portion 30 of their length, grid lines 10 thus exhibit openings 31 distributed to form a netting, while ensuring an electric continuity on either side of seal 7.

Figure 5:
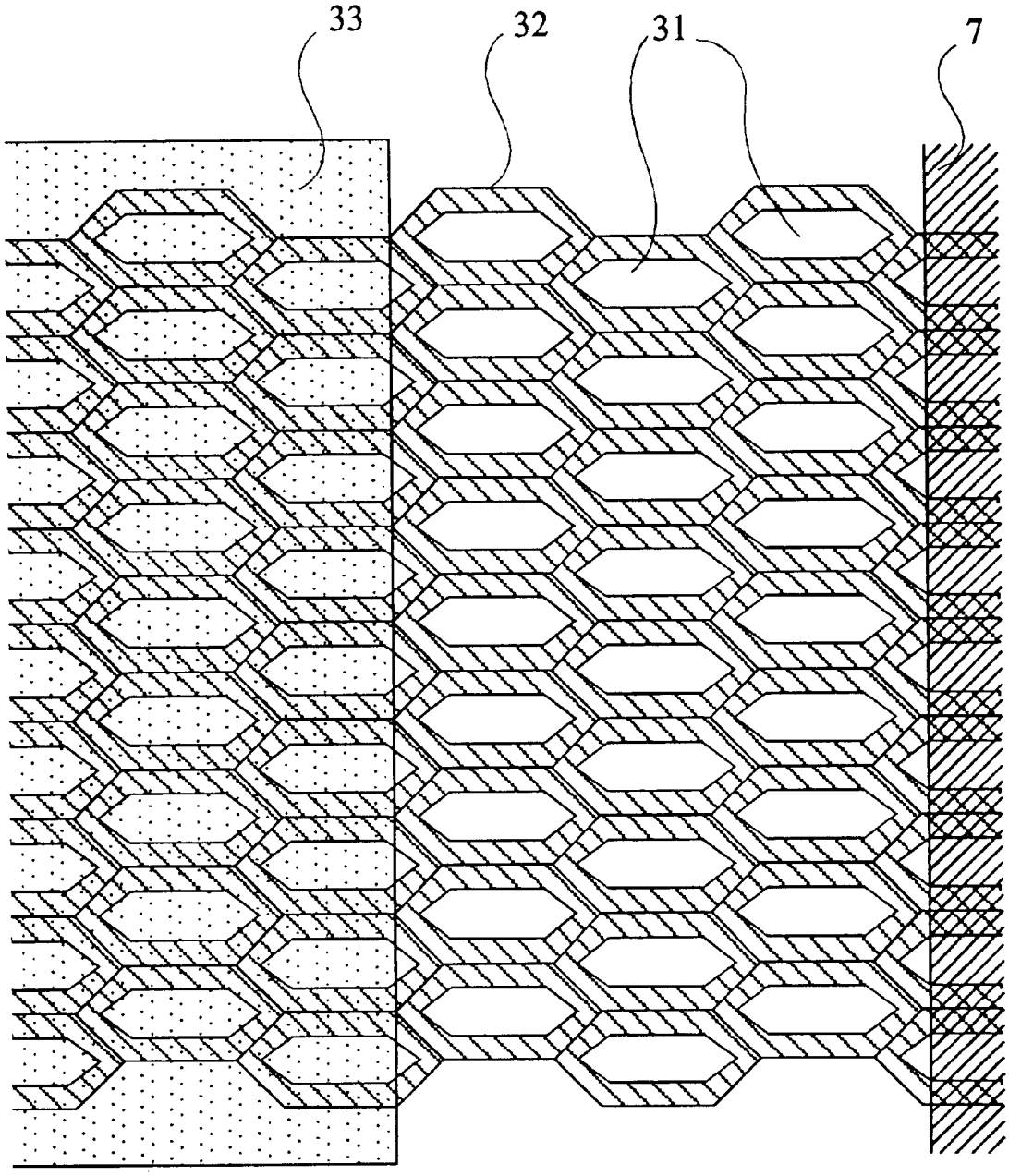
FIG. 5 partially shows a detail of a grid line according to the present invention.

Preferably, and as will be seen hereafter in relation with FIG. 5, the pattern of openings 31 made in regions 30 of the grid lines is such that these lines do not have any rectilinear conductive portion, be it in the general direction of their length or of their width. The possibility of stress propagation in the grid lines above the sealing wall is thus further reduced.

An advantage of the embodiment illustrated in relation with FIG. 2 is that it is perfectly compatible with present methods of flat screen manufacturing. Thus, in the embodiment of FIG. 2, grid lines 10 are made, for example, of niobium.

Figure 3:
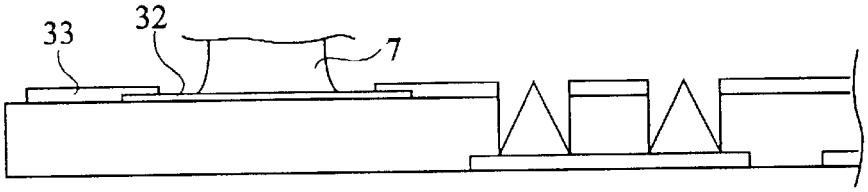
FIG. 3 is a partial cross-sectional view of a cathode-grid of a flat microtip screen illustrating a second embodiment of an electric grid connection according to the present invention.
Figure 4:
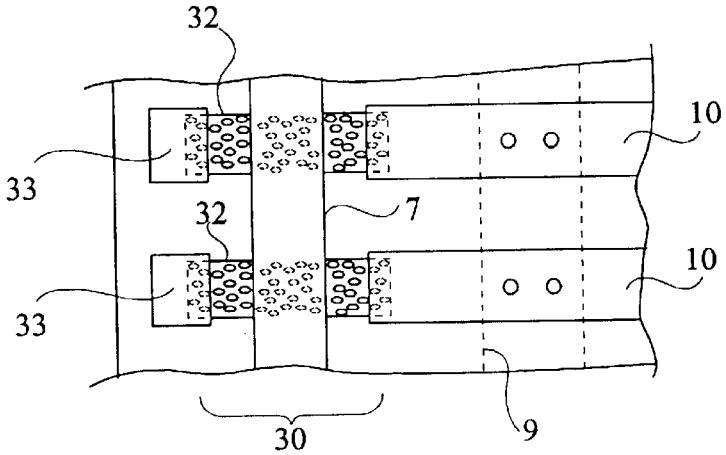
FIG. 4 is a top view of the cathode-grid shown in FIG. 3.

FIGS. 3 and 4 illustrate a second embodiment of the present invention. FIG. 3 is a partial cross-sectional view under a sealing wall. FIG. 4 is a view similar to that of FIG. 2.

A feature of this embodiment is to provide, in region 30 of the grid lines substantially under sealing wall 7, a section 32 made of a different conductive material. The material constitutive of section 32 is, according to the present invention, chosen to be compatible with the material constitutive of sealing wall 7 so as not be damaged by said wall. Section 32 is, like in the first embodiment, open-worked to make its expansion easier and thus minimize the effects of stress linked to the differences of thickness and expansion coefficient of the stacked materials.

As an example of implementation, sections 32 of grid lines 10 are made of chromium.

Preferably, the rest of the grid lines, at least on the side of the active screen area, is made of niobium. The creation of cracks by the chromium in the silicon oxide separating the grid from the cathode in the active screen area is thus avoided. Niobium is preferred to chromium in conventional screens for this very reason.

Preferably, on the outer screen side, niobium pads 33 are connected to sections 32. An advantage of maintaining niobium external connection pads 33 is that it is compatible with present methods of screen manufacturing.

FIG. 5 shows an embodiment of the pattern of a grid line region 30 under a sealing wall 7. This embodiment respects the above-mentioned preferences, that is, it avoids linear stress areas, to prevent any crack propagation in the underlying silicon oxide. For this purpose, region 30 includes no continuous rectilinear portion, be it widthwise or lengthwise, or in any other direction.

According to the embodiment illustrated in FIG. 5, the grid lines are honeycomb-shaped in region 30.

It should however be noted that other patterns may be chosen, provided that they respect the above-mentioned constraints.

It should also be noted that the resistivity differences between the materials chosen to form the grid lines inside the screen and sections 32 of passage under the wall are not critical in the present invention. Indeed, the grid lines are generally wide enough under the sealing wall for the resistivity differences to have no remarkable effect.

As a specific example of embodiment, niobium deposited with a thickness of 4000 Å has a resistivity of 4 ohms per square, while chromium deposited with the same thickness has a resistivity of 2 ohms per square. An interconnection of the type illustrated in FIG. 5 could for example be made with such thicknesses. The width of chromium sections 32 is, for example, between 5 and 10 $\mu$m. The surface of openings 31 is, for example, on the order of 500 $\mu m^2$.

Of course, the present invention is likely to have various alterations, modifications, and improvements which will readily occur to those skilled in the art. In particular, adapting the manufacturing method of a conventional screen to implement the present invention is within the abilities of those skilled in the art. Further, other materials than those indicated hereabove as an example may be used provided that they respect the described functional constraints. Moreover, although the present invention has been described in relation with a grid of a microtip screen, it applies to any electric connection by means of a thin layer between the inside and the outside of a flat screen under or over a sealing wall.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. An electric connection between an internal space (8) of a flat screen and an outside by means of a conductive line (10) of small thickness underlying a substantially thicker peripheral seal (7), including an open-worked structure making its expansion easier, said open-worked structure being such that the electric connection has no rectilinear conductive section.

2. A flat microtip screen grid formed of lines (10) deposited on an insulating layer (11) coating cathode conductors (9), wherein each grid line is provided with at least one electric connection of claim 1.

3. The grid of claim 2, made of chromium.

4. The grid of claim 2, wherein each line (10) is made of niobium in the active screen area, each electric connection (32) being made of chromium.

5. A flat display screen including a cathode (2) with microtips (3) for bombarding a cathodluminescent anode (5), including the grid (4) of claim 2.

* * * * *